United States Patent [19]

Yester, Jr. et al.

[11] Patent Number: 4,602,229

[45] Date of Patent: Jul. 22, 1986

[54] RESONANT BANDPASS T FILTER AND POWER SPLITTER

[75] Inventors: Francis R. Yester, Jr., Arlington Heights; Mark A. Gannon, Schaumburg, both of Ill.

[73] Assignee: Motorola, Inc., Schaumburg, Ill.

[21] Appl. No.: 567,436

[22] Filed: Dec. 30, 1983

[51] Int. Cl.[4] ..... H01P 1/203; H01P 1/208; H01P 1/201

[52] U.S. Cl. ..... 333/208; 333/1; 333/135; 333/204; 333/212

[58] Field of Search ..... 333/202, 204–212, 333/219, 222–235, 251, 245, 246, 248, 81 A, 81 B, 132, 134, 135, 1, 110, 100

[56] References Cited

U.S. PATENT DOCUMENTS

| | | | |
|---|---|---|---|
| 2,434,646 | 1/1948 | Fox | 333/135 |
| 2,595,680 | 5/1952 | Lewis | 333/110 |
| 2,816,270 | 12/1957 | Lewis | 333/208 X |
| 2,853,687 | 9/1958 | Weber | 333/81 B |
| 2,879,484 | 3/1959 | Miller | 333/110 |
| 2,898,561 | 8/1959 | Hayes | 333/248 X |
| 2,939,093 | 5/1960 | Marie | 333/110 |
| 3,048,804 | 8/1962 | Drum | 333/251 X |
| 3,212,034 | 10/1965 | Kaufman et al. | 333/209 |
| 3,548,348 | 12/1970 | Gerdine | 333/251 |
| 3,602,847 | 8/1971 | Stagg | 333/135 |
| 3,938,064 | 2/1976 | O'Brian, Jr. et al. | 333/204 |
| 4,028,652 | 6/1977 | Wakino et al. | 333/209 |
| 4,121,181 | 10/1978 | Nishikawa et al. | 333/202 |

FOREIGN PATENT DOCUMENTS

| | | | |
|---|---|---|---|
| 1330838 | 9/1973 | United Kingdom | 333/132 |
| 229698 | 10/1968 | U.S.S.R. | 333/132 |
| 467534 | 11/1976 | U.S.S.R. | 333/134 |
| 866616 | 9/1981 | U.S.S.R. | 333/209 |

*Primary Examiner*—Marvin L. Nussbaum
*Attorney, Agent, or Firm*—F. John Motsinger; Edward M. Roney; James W. Gillman

[57] ABSTRACT

In accordance with the present invention there is provided a bandpass T filter and power splitter for electromagnetic energy. It is composed of a plurality of resonant elements serially arranged to form a plurality of forward multi-pole bandpass filters. At least one resonant element is common to both signal paths. The common resonant element transfers energy from the common path to the independent signal paths to effect a power split. The two signal output paths are isolated from one another by a multi-pole bandpass filter. The resonant elements may be composed of either resonant waveguide cavities or dielectric resonators.

13 Claims, 5 Drawing Figures

RESONANT BANDPASS T FILTER AND POWER SPLITTER

A method for maintaining constant bandwidth over a frequency spectrum in a dielectric resonator filter.

A method to achieve a desired bandwidth at a given frequency in a dielectric resonator filter.

A dielectric resonator filter to achieve a desired bandwidth characteristic.

THE FIELD OF INVENTION

The disclosed invention, herein, is concerned with power splitting and filtration of electromagnetic energy.

More particularly, this invention relates to ways bandpass filtering and power splitting electromagnetic energy with resonant elements.

Specifically, this application discloses an apparatus for bandpass filtering and power splitting microwave energy in a coupled dielectric resonator bandpass T filter that performs forward filtration, power splitting and output isolation in a single device.

BACKGROUND OF THE INVENTION

With increased spectral crowding at lower frequencies, microwave communications have become a viable alternative and present some interesting opportunities. However, microwave communications have their own set of particularized problems that need to be resolved before extensive commercialization of microwave communications can be realized.

Microwave components are relatively massive mechanical elements that are both difficult and expensive to manufacture. The cost and complexity of microwave components can rapidly accelerate in systems requiring redundancies or multiple signal paths.

In point to point communication systems, redundant receivers are employed to enhance the reliability of the communications system despite occasional equipment failure. Typically, one receiver is active in the communication system while the other receiver is on hot standby-that is, it is actively receiving and can be switched into the communications system in the event of a failure of the active receiver.

A redundant receiver system is shown in FIG. 1. Microwave energy is received by an antenna and introduced into a T shaped waveguide to split the microwave energy into two forward paths. Each signal path must be filtered to the proper bandwidth and variably attenuated before reaching the receiver. Duplicate filters must be inserted in each signal path rather than in the common signal path because the filter is required to maintain isolation between the two receivers. Otherwise, the local oscillator signal from one receiver would feed through the power splitter into the other receiver causing unacceptably strong beat notes whose frequency would be the difference between the frequencies of the two local oscillators.

The challenge, then, was to drastically reduce the number of individual components required in a redundant system and, thereby, reduce the insertion losses associated with each component while maintaining or enhancing performance.

This invention met that challenge by providing a single device that performs forward bandwidth filtration, power splitting, output isolation, and variable attenuation in one compact apparatus.

BRIEF SUMMARY OF THE INVENTION

It is the object of this invention to provide a resonant bandpass T filter and power splitter that performs forward bandwidth filtration, power splitting and output isolation in a single device.

In accordance with the present invention there is provided a bandpass T filter and power splitter for electromagnetic energy. It is composed of a plurality of resonant elements serially arranged to form a plurality of forward multi-pole bandpass filters. At least one resonant element is common to both signal paths. The common resonant element transfers energy from the common path to the independent signal paths to effect a power split. The two signal output paths are isolated from one another by a multi-pole bandpass filter. The resonant elements may be composed of either resonant waveguide cavities or dielectric resonators.

BRIEF DESCRIPTION OF THE DRAWINGS

Additional objects, features, and advantages in accordance with the present invention will be more clearly understood by way of unrestricted example from the following detailed description taken together with the accompanying drawings in which.

The invention will be readily appreciated by reference to the detailed description when considered in conjunction with the accompanying drawings in which like reference numerals designate like parts throughout the figures.

THE DESCRIPTION OF THE PREFERRED EMBODIMENT

Figure 1:
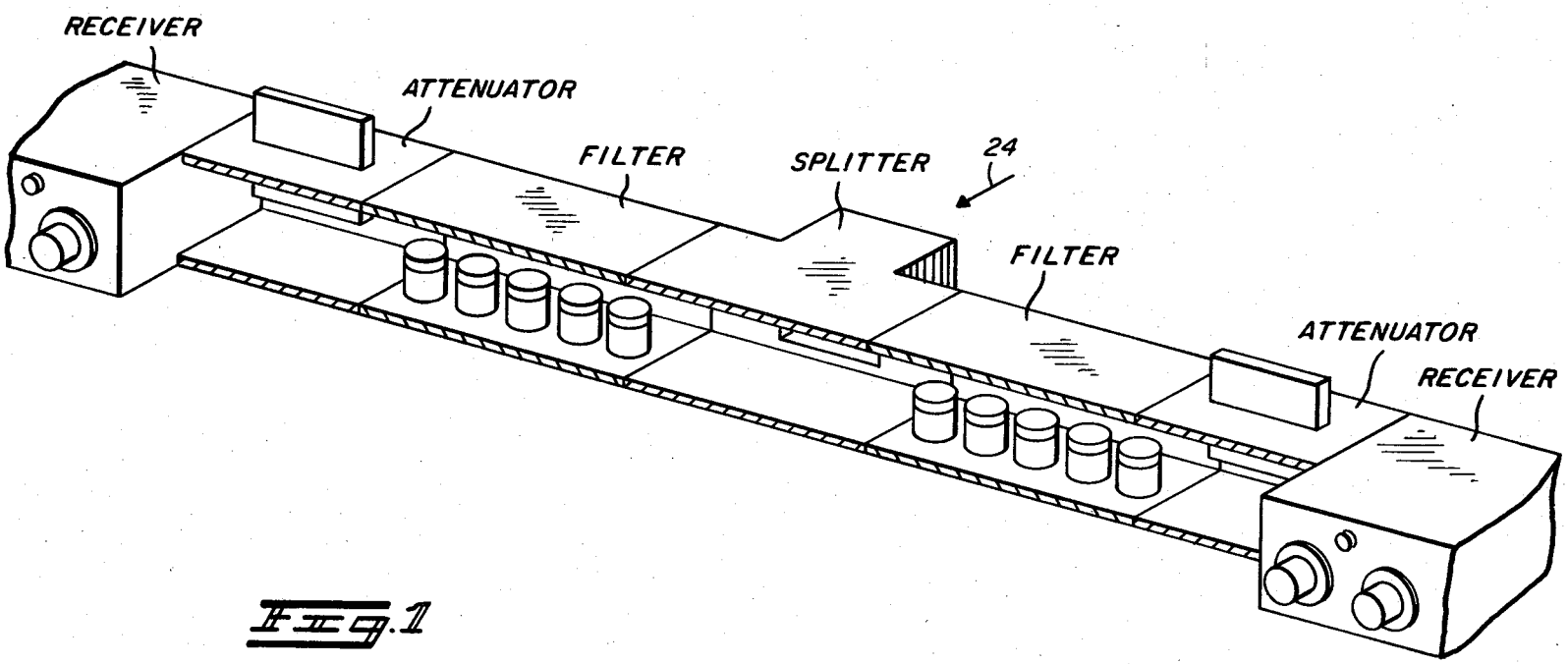
FIG. 1 illustrates a conventional way to process electromagnetic energy in a redundant receiver communication system.
Figure 2:
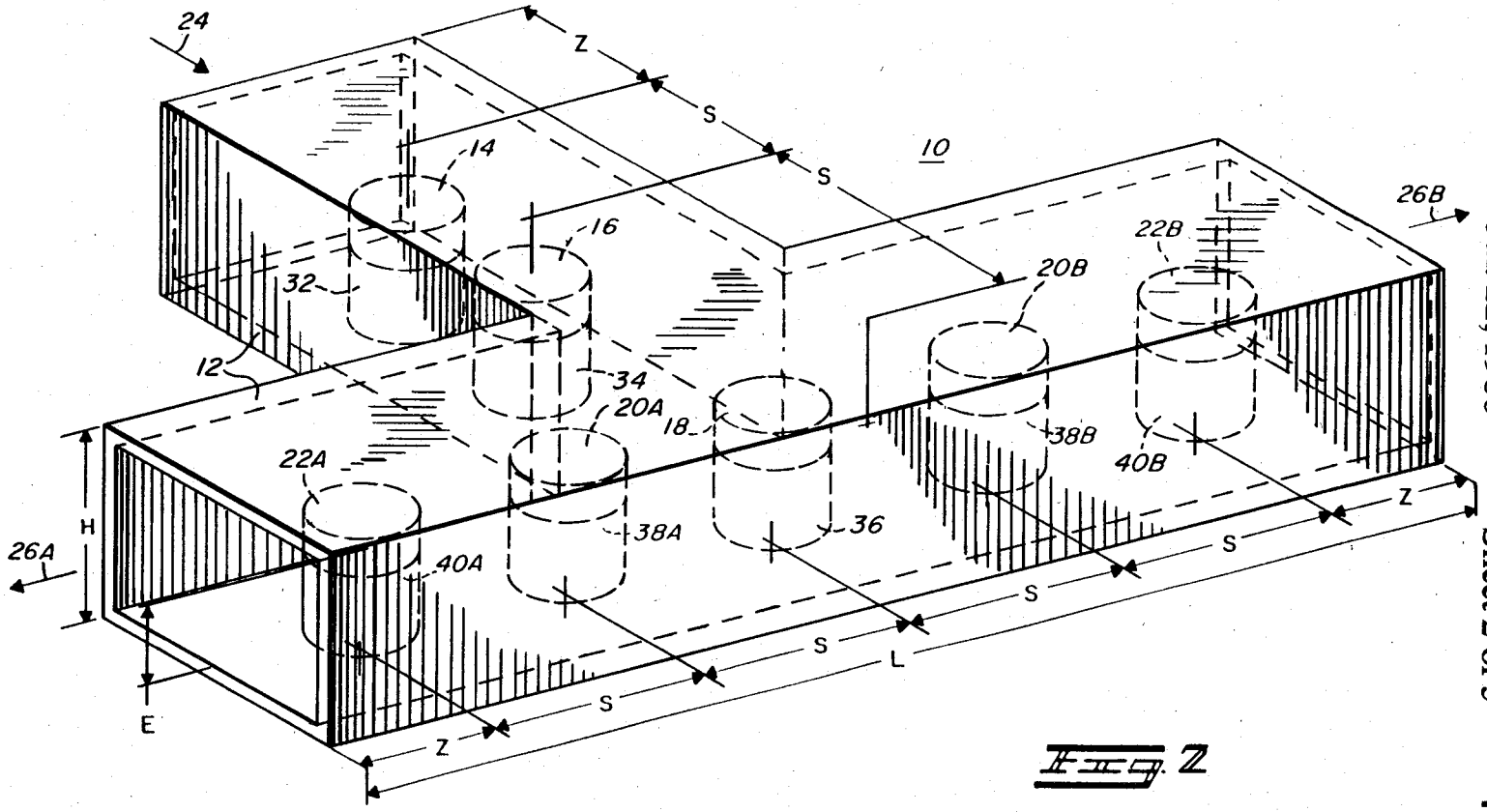
FIG. 2 is a perspective illustration of a five-pole dielectric resonator microwave bandpass T filter and power splitter which incorporates the preferred embodiment of the present invention.

FIG. 2 illustrates the preferred embodiment of a five-pole dielectric resonator waveguide bandpass T filter and power splitter, generally designated 10, which incorporates the present invention.

Microwave waveguide dielectric resonator filters have been employed to perform forward bandpass functions. Ordinarily, a waveguide 12 of rectangular cross section is provided with a dielectric resonator 14 that resonates at a single center frequency as it is excited by the microwave electromagnetic field. The response characteristic of the filter 10 can be altered by introducing a number of dielectric resonators 16–22 in proximity with each other such that the radiated energy coupled from one resonator 14 to the next 16–22 alters the bandwidth of the filter.

In the preferred embodiment, the transmission medium 12 for the electromagnetic field to be filtered is a waveguide 12 of rectangular cross section operating in the evanescent mode (i.e., below cut off). In accordance with known methodology, the height H and width W of the waveguide 12 are chosen such that the waveguide 12 will cut off all frequencies below a certain level, yet allow a higher frequency spectrum to propagate throughout the waveguide 12. The ratio of width W to the height H is chosen to properly orient the electric and magnetic components of the electromagnetic field. The height H and the width W are chosen such that H is smaller than W so that the magnetic field is distributed across the height H while the electric field is distributed across the width W. The height H and the width W are also chosen so as not to substantially interfere with the quality factor Q of the dielectric resonators 14–22. To avoid interferring with the resonator quality factor Q, the height H is chosen to be three to four times the resonator thickness T and the width W is chosen to be two to three times the resonator diameter D.

The response characteristic of the filter 10 can be altered by introducing a number of dielectric resonators 14–22 in proximity with each other such that the radiated energy coupled from one resonator to the next alters the bandwidth of the filter. It is well known that the bandwidth of the filter 10 is a function of the product of the resonant frequency of the filter and the interresonator coupling coefficient-a coefficient of the energy coupled between resonators. In an evanescent mode waveguide (a waveguide below cut off), dielectric resonators are usually cascaded at the cross sectional center line of a rectangular waveguide 12 (i.e. at the electromagnetic field maxima). To achieve a desired bandwidth, the resonators 14–22 are longitudinally spaced S to provide the desired interresonator coupling. Accordingly, the length L of the waveguide 12 is determined by the sum of the interresonator spacings S and the proper spacing Z for coupling the entry 24 and exit ports 26 to other devices.

Electromagnetic energy may be introduced at the entry port 24 of the waveguide filter 10 by an appropriate waveguide transition (not shown) or by microstrip (not shown) brought in close proximity to the first dielectric resonator 14. Similarly, electromagnetic energy may be extracted from the filter 10 by an appropriate waveguide transition (not shown) or by microstrip 28 brought in close proximity to the last dielectric resonator 22 at the exit port 26.

Figure 3:
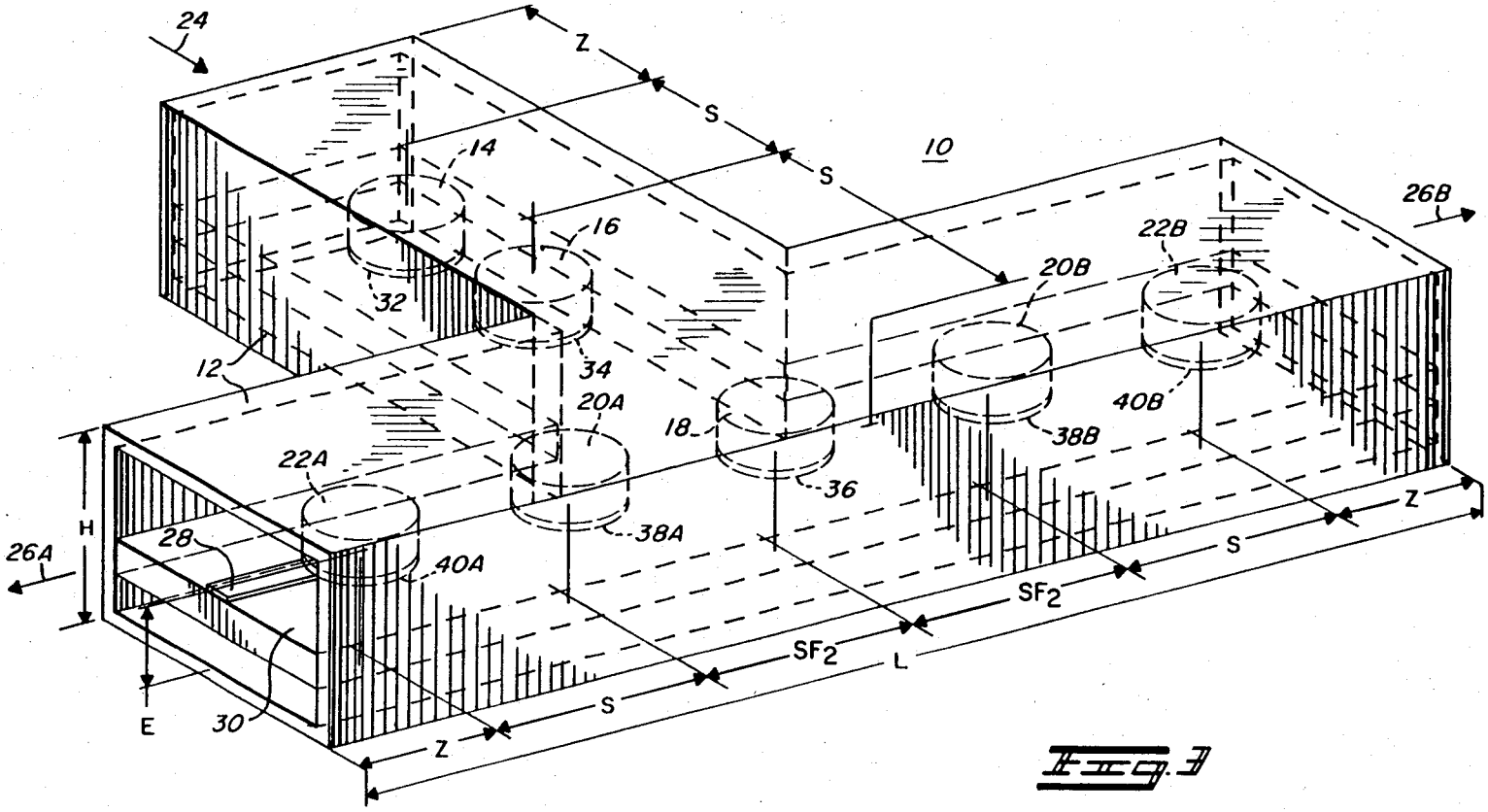
FIG. 3 is a perspective illustration of a five-pole dielectric resonator microwave bandpass T filter and power spitter incorporating an apparatus for mounting and locating dielectric resonators to achieve a desired bandwidth characteristic, as further detailed in the related copending patent applications.

As illustrated in FIG. 2, the dielectric resonators 14–22 may be mounted upon precision pedestals 32–40, having a relatively low dielectric constant. Even more advantageously, the dielectric resonators 14–22 may be mounted upon a substrate 30 as illustrated in FIG. 3 in accordance with the constant bandwidth invention of the co-pending related patent applications.

The diameter D and the thickness T of the dielectric resonators 14–22 are chosen so that they resonate in their fundamental mode at the desired resonant frequency and such that higher order modes are minimized. A diameter D to thickness T ratio (D/T) of two to three has proved to be particularly advantageous.

The dielectric resonators 14–22 receive electromagnetic energy from the entry port 24 are excited to resonate at one frequency, and, in turn, radiate energy at the resonant frequency. The energy dies off exponentially with distance S from each resonator 14. If a second resonator 16–22 is brought close enough to the energy radiated by the first resonator 14, the second resonator 16–22 will be excited to resonate also. The second resonator 16–22, in turn, will re-radiate energy in all directions, coacting to excite the first 14 and the third 18 resonators. This interresonator coupling is responsible for altering the response characteristic of a single dielectric resonator 14 to achieve a wider and sharper bandwidth characteristic.

The amount of energy intercepted by the fourth resonator 20 is a function of its distance from and the amount of energy launched by the third resonator 18. Since dielectric resonators re-radiate energy in all directions, the dielectric resonator that is common to both signal paths 18 transfers energy to both resonator 20A and 20B. It is this common resonant element 18 that affects the power split between two signal paths A and B. The relative magnitude of the energy radiated to either signal path depends upon the relative distance of dielectric resonators 20A and 20B from the common dielectric resonator 18. Since power goes as the interresonator coupling coefficient squared, an equal power split is effectuated when both distances equal the square root of 2 times the normal interresonator spacing S.

The resultant structure is a coupled dielectric resonator bandpass T filter and power splitter that splits the electromagnetic energy between two signal paths (14–22A and 1414 22B), that has two five-pole dielectric resonator bandpass forward filters (14–22A and 14–22B), and has the two signal paths isolated by a five-pole dielectric bandpass filter 22A–22B whose center frequency is the center frequency of the T filter. This isolation at frequencies other than the center frequency is necessary to keep one output port 26A from interfering with the signal at the other output port 26B. This isolation is required in a redundant receiver system where the local oscillator signal from one receiver would feed through the power splitter into the other receiver causing unacceptably strong beat notes whose frequency would be the difference between the local oscillators of the two receivers.

Figure 4:
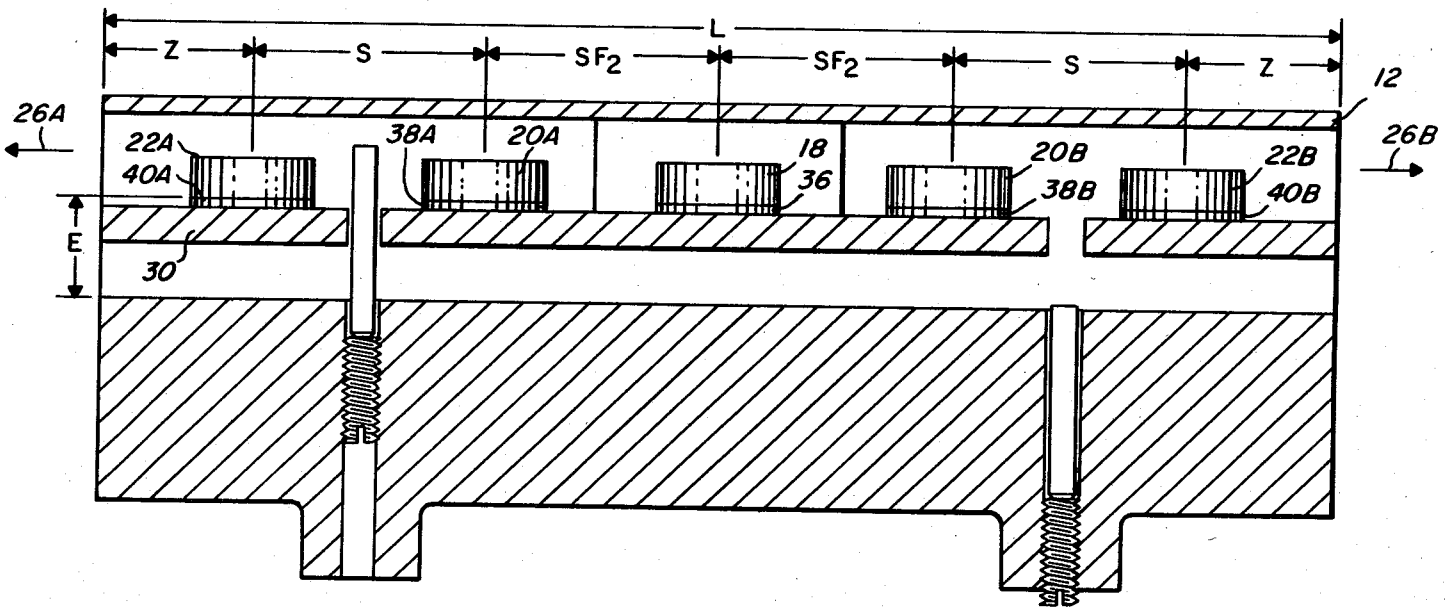
FIG. 4 is a cross sectional view of a five-pole dielectric resonator microwave bandpass T filter and power splitter which incorporates variable attenuators.

As illustrated in FIG. 4, the energy coupled from one resonator 20 to another 22 may be attenuated by introducing a callibrated amount of resistive or metallic material 32 between the resonators. This variable attenuator attenuates the signal reaching the end resonator 22 and, correspondingly, the signal reaching the output port 26. This variable attenuator is useful to check the path fade margin of a redundant receiver microwave relay system. One receiver is kept active while the other receiver is monitored as its attenuator adds more and more attenuation. When the monitored receiver's squelch cuts in, the amount of attenuation is read from the calibration markings.

Thus, there has been provided a coupled dielectric resonator bandpass T filter and power splitter that performs forward filtration, power splitting and output isolation in a single, integrated device.

Figure 5:
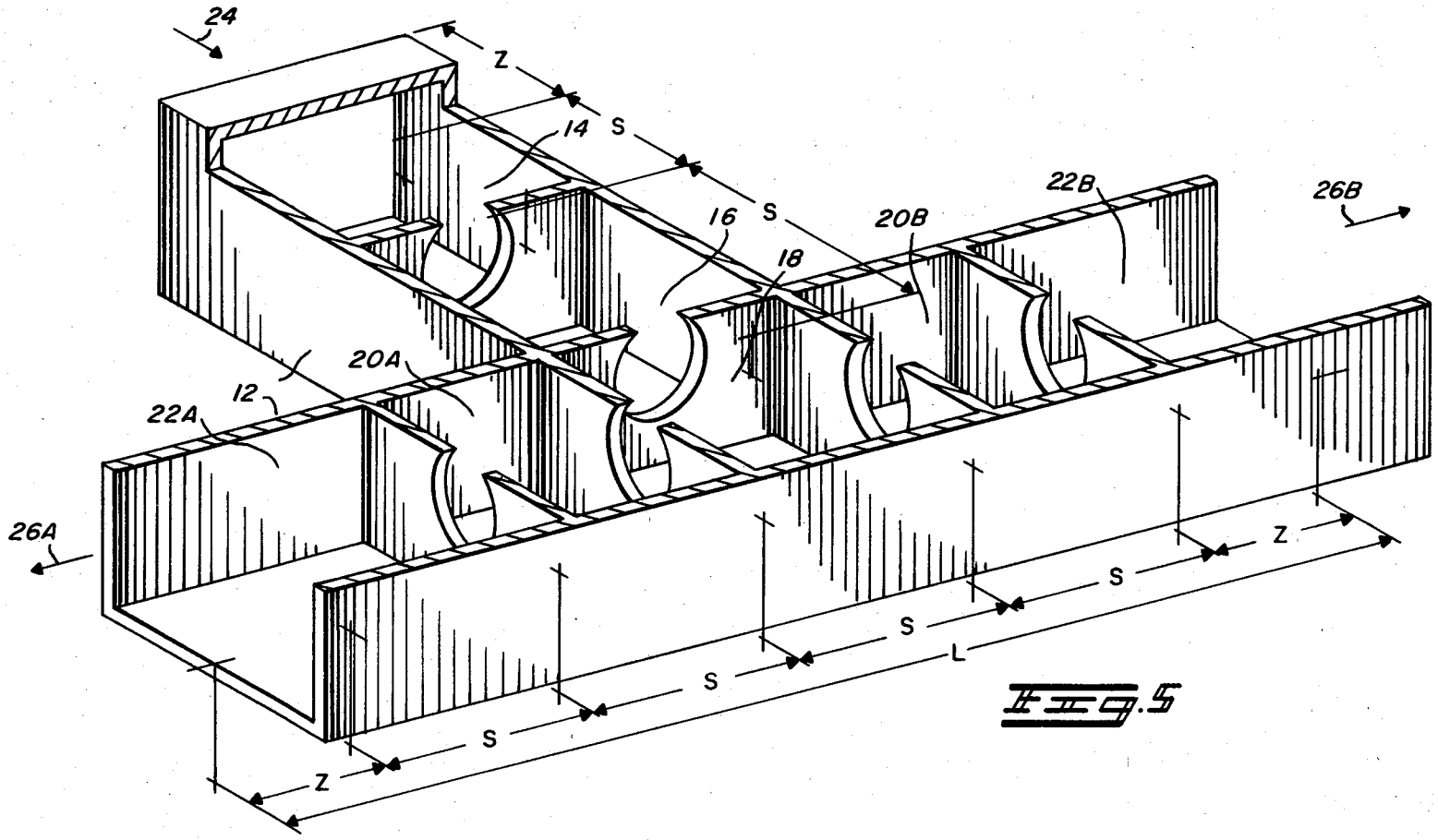
FIG. 5 is an illustration of a five-pole resonant cavity waveguide bandpass T filter and power splitter which is an alternate embodiment of this invention.

As illustrated in FIG. 5, it will be appreciated by those skilled in the art that waveguide resonant cavities may be used as the resonant element in lieu of dielectric resonators. Similarly, round rather than rectangular waveguide may be used as the transmission medium as well as microstrip and free space. It will further be appreciated that the dielectric resonators 14–22 need not be discs nor in a horizontally cascaded orientation.

The foregoing description of the various embodiments are illustrative of the broad invention concept comprehended by the invention and has been given for clarity of understanding by way of unrestricted example. However, it is not intended to cover all changes and modifications which do not constitute departures from the spirit and scope of this invention.

We claim:

1. A T-filter and power splitter/combiner comprising:

a first filter having a resonant center frequency, further comprising a plurality of resonant elements; and a second filter having substantially the same resonant center frequency as that of the first filter, further comprising a plutality of resonant elements, at least one of the resonant elements of the second filter comprising one of the resonant elements of the first filter.

2. A filter and power splitter as claimed in claim 1 wherein the resonant elements further comprise resonant waveguide cavities.

3. A filter and power splitter as claimed in claim 1 wherein the resonant elements include dielectric resonators.

4. A filter and power a splitter as claimed in claim 1 or 3 wherein the resonant elements include a transmission medium.

5. A filter and power splitter as claimed in claim 4 wherein the transmission medium is free space.

6. A filter and power splitter as claimed in claim 4 wherein the transmission medium is microstrip.

7. A filter and power splitter as claimed in claim 4 wherein the transmission medium is waveguide.

8. A filter and power splitter as claimed in claim 3 wherein the dielectric resonators are mounted upon pedestals about a transmission medium.

9. A filter and power splitter as claimed in claim 3 wherein the dielectric resonators are mounted upon a substrate.

10. A filter and power splitter as claimed in claim 9 wherein the substrate is mounted within a waveguide.

11. A filter and power splitter as claimed in claim 10 wherein the substrate is movable such that the position of the dielectric resonators may simultaneously be adjusted with respect to the electromagnetic field distributed across the waveguide cross section to achieve the desired filter bandwidth.

12. A filter and power splitter as claimed in claim 1 wherein a calibrated amount of resistive material is introduced between the resonant elements.

13. A T-filter and power splitter/combiner comprising:

a first filter having a resonant center frequency, further comprising a plurality of dielectric resonators; and a second filter having substantially the same resonant center frequency as that of the first filter, further comprising a plurality of dielectric resonators, at least one of the dielectric resonators of the second filter comprising one of the dielectric resonators of the first filter.

* * * * *

UNITED STATES PATENT AND TRADEMARK OFFICE

CERTIFICATE OF CORRECTION

PATENT NO. : 4,602,229

DATED : July 22, 1986

INVENTOR(S) : Yester, Jr. et al.

It is certified that error appears in the above-identified patent and that said Letters Patent is hereby corrected as shown below:

Claim 1, line 14, delete the word "plutality" and insert thereat --plurality--.

Claim 4, line 25, between the words power and splitter, delete the word "a".

Signed and Sealed this

Seventh Day of October, 1986

[SEAL]

*Attest:*

DONALD J. QUIGG

*Attesting Officer*

*Commissioner of Patents and Trademarks*